US006638897B2

(12) United States Patent
Ogano et al.

(10) Patent No.: US 6,638,897 B2
(45) **Date of Patent: *Oct. 28, 2003**

(54) LUBRICANT OIL COMPOSITION FOR INTERNAL COMBUSTION ENGINES (LAW859)

(75) Inventors: Satoshi Ogano, Fujimi (JP); Nobuchika Kawagoishi, Ohi-Machi (JP); Makota Yoneda, Hidaka (JP); Toshiaki Kuribayashi, Saitama (JP)

(73) Assignee: TonenGeneral Sekiyu K.K., Saitama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/350,872

(22) Filed: Jul. 9, 1999

(65) Prior Publication Data

US 2001/0053750 A1 Dec. 20, 2001

(30) Foreign Application Priority Data

Jul. 17, 1998 (JP) ..... 10-219643
Feb. 12, 1999 (JP) ..... 11-033814

(51) Int. Cl.[7] ..... C10M 133/44; C10M 139/00

(52) U.S. Cl. ..... 508/192; 508/232; 508/287; 508/460

(58) Field of Search ..... 508/460, 192, 508/232, 287

(56) References Cited

U.S. PATENT DOCUMENTS

| | | | | | |
|---|---|---|---|---|---|
| 3,806,453 | A | | 4/1974 | McDole | 252/22 |
| 4,929,374 | A | | 5/1990 | De Jong et al. | 252/39 |
| 5,160,649 | A | | 11/1992 | Cardis et al. | 252/47.5 |
| 5,458,807 | A | | 10/1995 | Tamoto | 252/32.7 E |
| 5,631,212 | A | | 5/1997 | Vrahopoulou | 508/192 |
| 5,652,203 | A | * | 7/1997 | Asamori et al. | 508/460 |
| 5,658,862 | A | | 8/1997 | Vrahopoulou | 508/192 |
| 5,744,430 | A | | 4/1998 | Inoue et al. | 508/295 |
| 5,965,495 | A | * | 10/1999 | Goto et al. | 508/192 |
| 6,001,785 | A | * | 12/1999 | Le Coent et al. | 508/460 |
| 6,103,672 | A | * | 8/2000 | Dunn et al. | 508/460 |

FOREIGN PATENT DOCUMENTS

| | | | |
|---|---|---|---|
| EP | 0562172 | 9/1993 | C10M/141/08 |
| JP | 60006790 | 1/1985 | C10M/133/56 |
| JP | 63015895 | 1/1988 | B01D/35/02 |
| JP | 04001293 | 1/1992 | C10M/129/95 |
| JP | 05093197 | 4/1993 | C10M/163/00 |
| JP | 05230485 | 9/1993 | C10M/163/00 |
| JP | 05295382 | 11/1993 | C10M/163/00 |
| JP | 09111275 | 4/1997 | C10M/163/00 |
| JP | 09165591 | 6/1997 | C10M/167/00 |
| RU | 2058375 | 4/1996 | C10M/129/54 |
| WO | WO8704454 | 7/1987 | C10M/129/06 |

* cited by examiner

*Primary Examiner*—Jacqueline V. Howard
(74) *Attorney, Agent, or Firm*—Norby L. Foss

(57) ABSTRACT

The lubricating oil of the present invention exhibits an excellent effect of agglomerating solid impurity particles it contains to a sufficiently large size as to be captured and removed by an oil filter.

7 Claims, No Drawings

LUBRICANT OIL COMPOSITION FOR INTERNAL COMBUSTION ENGINES (LAW859)

FIELD OF INDUSTRIAL UTILIZATION

This invention relates to a lubricant oil composition, more particularly a lubricating oil composition of longer service interval for internal combustion engines, in particular diesel engines, which are equipped with a filtration means, e.g., oil filter, to efficiently capture and remove agglomerated solid impurities, e.g., soot inevitably produced while a diesel engine is driven.

BACKGROUND OF THE INVENTION

Lubricant oils have been used for internal combustion engines to lubricate various members, e.g., piston rings, cylinder liners, bearings for crank shafts and connecting rods, valve train mechanisms including cams and valve lifters, and other reciprocating lubrication regime. In addition to the lubricating purposes above described, they are also used for cooling engines, cleaning and dispersing combustion products, and prevention of rust and corrosion.

As described above, lubricant oils for internal combustion engines are required to exhibit a variety of functions. These requirements are becoming more severe, as the engines become more functional, produce higher power and are operated under more severe conditions. In order to satisfy these requirements, lubricant base oils for internal combustion engines are incorporated with a variety of additives, such as ashless dispersant, metallic detergent, antiwear agent, friction reducing agent and antioxidant.

Lubricant oils for internal combustion engines have been incorporated with a combination of ashless dispersant and metallic detergent. The ashless dispersants generally include those based on polyalkenyl or polyalkyl succinamide, polyalkenyl or polyalkyl succinic acid ester, polyalkenyl or polyalkyl benzyl amine. These compounds may be treated with boron. On the other hand, the metallic detergents generally include those based on phenate, sulfonates, salicylates and phosphonates of alkali and alkali-earth metals. These compounds may be overbased.

A diesel engine structurally produces larger quantities of solid impurities insoluble in lubricant oil, e.g., combustion residue and soot, than does a gasoline engine, and causes contamination of the lubricant oil and lubricating systems with them. Various problems will occur as the extent of the contamination increases, e.g., sharply increased viscosity of the lubricant oil and at the rubbing surfaces of the engine parts, and clogging in the lubricating systems, preventing smooth control of lubrication and needing frequent replacement of lubricating oil.

A variety of measures and means have been proposed to remove solid impurities insoluble in lubricating oil, e.g., combustion residue and soot, in order to solve these problems. These measures and means fall into the following two general categories:

The first category is to agglomerate the solid impurities to make them coarser, and capture and remove them by an oil filter installed in a lubricating oil recycling system. This concept leads to development of lubricating oils incorporated with calcium phenate of specific total base number, magnesium sulfonate of specific total base number or alkenyl succinimide to agglomerate solid impurities (Japanese Patent Publication No. 3-29839, and Japanese Laid-open Patent Application No. 5-295382); and lubricating systems for diesel engines, which use lubricating oil compositions incorporated with two types of calcium sulfonate of specific total base number, calcium phenate of specific total base number, alkenyl succinimide or zinc dithiophospate (Japanese Patent Publication No. 6-60317). Those based on the similar technical concept include diesel engine oils incorporated with a hydroxyethyl thiophosphonate ester or the like to help remove the combustion residue by an oil filter while keeping adequate dispersibility (Japanese Laid-open Patent Application No. 4-1293 and No. 5-93197); and overland diesel engine oils incorporated with a combination of succinimide and long-chain zinc dialkyl dithiophosphate to help remove solid impurities while controlling dispersibility (Japanese Laid-open Patent Application No. 5-230485).

The second category, different from the first category in basic concepts, tries to prevent agglomeration of solid impurities, e.g., soot, in oil and disperse the solid impurities themselves finely in oil. Specifically, the proposed techniques falling into this category include diesel engine oils incorporated with calcium phenate of specific total base number, alkenyl succinimide or specific zinc dithiophosphate which are capable of controlling particle size of soot (Japanese Laid-open Patent Application No. 9-165591); and lubricants incorporated with a transition metal salt to directly control soot (Japanese Laid-open Patent Application No. 1-501396).

Low-phosphorus, low-ash type diesel engine oils are also proposed for diesel engines equipped with a diesel particulate filter (DPF). They are incorporated with a specific content of zinc dialkyl dithiophosphate, calcium salicylate overbased with calcium carbonate and having a specific total base number and/or calcium salicylate overbased with calcium borate, or boron-modified succinimide having a specific molecular weight (Japanese Laid-open Patent Application No. 9-111275).

Few of the above techniques, however, provide lubricating oil systems of satisfactory serviceability for diesel engines. In particular, all of the techniques falling in the first category fail to efficiently capture and remove agglomerated solid impurities (e.g., soot) by a filter means (e.g., oil filter) while keeping long serviceability for diesel engines.

The present invention provides a lubricant oil composition of longer service interval for internal combustion engines, exhibiting an excellent effect of agglomerating solid impurity particles it contains to a sufficiently large size as to be captured and removed by an oil filter.

DESCRIPTION OF THE INVENTION

The present invention is directed to a lubricant oil composition comprising a base oil composed of a mineral oil, synthetic oil or mixtures thereof which can agglomerate solid impurities (e.g., soot) to make them sufficiently coarser, when the base oil is incorporated with specific contents of calcium salicylate overbased with calcium carbonate and succinimide having a specific weight-average molecular weight.

In the first aspect the invention provides a lubricant oil composition for internal combustion engines, comprising a base oil composed of a mineral oil, synthetic oil or mixture thereof which is incorporated with (A) calcium salicylate overbased with calcium carbonate and having a total base number of 30 to 350 mgKOH/g at 0.10 to 0.90 wt % (as calcium), and (B) a succinimide selected from the group consisting of boron-containing succinimide having a weight-average molecular weight of 3,000 or less at 0.04 wt % or less (as boron derived from the boron-containing succinimide), succinimide having a weight-average molecular weight of 2,500 or less at 0.01 to 0.25 wt % (as nitrogen), and mixtures hereof the above percentages being based on the whole composition.

Further, in the second aspect the invention provides a lubricant oil composition for internal combustion engines, comprising a base oil composed of a mineral oil synthetic oil or mixture thereof which is incorporated with (A) calcium salicylate overbased with calcium carbonate and having a total base number of 30 to 100 mgKOH/g at 0.05 to 0.90 wt % (as calcium), and (B) a succinimide selected from the group consisting of boron-containing succinimide having a weight-average molecular weight of 3,000 or less at 0.04 wt % or less (as boron derived from the boron-containing succinimide), succinimide having a weight-average molecular weight of 3,000 or less at 0.01 to 0.25 wt % (as nitrogen) thereof and mixtures, the above percentages being based on the whole composition.

As described above, the present invention provides a lubricant oil composition for internal combustion engines, comprising a base oil incorporated with specific contents of calcium salicylate overbased with calcium carbonate and succinimide having a specific weight-average molecular weight. The preferred embodiments of the present invention include:

(1) a lubricant oil composition for internal combustion engines described above either, wherein the composition is for overland diesel engines, (2) a lubricant oil composition for internal combustion engines described above either, wherein the internal combustion engine is a diesel engine equipped with a by-pass oil filter, (3) a lubricant oil composition for internal combustion engines described above either, wherein the boron-containing succinimide has a weight-average molecular weight of 2,000 or less, (4) a lubricant oil composition for internal combustion engines described above either, wherein the succinimide has a weight-average molecular weight of 2,100 or less, and (5) a lubricant oil composition for internal combustion engines described above either, wherein the base oil is incorporated with, in addition to the above compounds, at least one type of additives selected from the group consisting of antiwear agent, friction reducing agent, antioxidant, viscosity index improver, pour point depressant, rust inhibitor, corrosion inhibitor, antifoamant and others which are required by a lubricant oil composition for internal combustion engines.

DETAILED DESCRIPTION OF THE PRESENT INVENTION

(1) Lubricant Base Oil

The base oil for the lubricant oil composition is a mineral oil and/or synthetic oil. It is not limited, and any one commonly used as a base oil can be used for the present invention, e.g., mineral oil, synthetic oil and mixture thereof.

The mineral oils useful for the present invention include lubricant stocks, obtained by atmospheric or vacuum distillation of paraffinic, intermediate base or naphthenic crude, e.g., raffinate from solvent extraction with an aromatic compound extracting solvent such as phenol, furfural and N-methyl pyrrolidone; hydrotreated oil obtained by treating stocks with hydrogen under hydrotreatment conditions in the presence of a hydrotreatment catalyst, such as cobalt and molybdenum carried by silica-alumina; hydrocrackate obtained by treating stocks with hydrogen under severer hydrocracking conditions; isomerate obtained by isomerizing stocks with hydrogen under isomerization conditions in the presence of an isomerization catalyst; and those stocks obtained by a combination of solvent refining, hydrotreatment, hydrocracking or isomerization. Particularly preferable base oils for the present invention are those having a high viscosity index, obtained by hydrocracking or isomerization. Any process described above can be optionally combined with dewaxing, hydrofinishing, clay treatment or the like operated in a normal manner. More specifically, the base stocks useful for the present invention include light, medium and heavy neutral oils, and bright stocks. These base oils can be mixed with one another, to satisfy the requirements of the present invention.

The examples of synthetic base oils include poly-α-olefin, α-olefin oligomer, polybutene, alkylbenzene, polyol ester, dibasic acid, polyoxyalkylene glycol, polyoxyalkylene glycol ether, and silicone oil.

These base oils may be used individually or in combination. A mineral oil may be combined with a synthetic oil. The base oil for the present invention generally has a kinematic viscosity of 2 to 20 $mm^2/s$ at 100° C., preferably 3 to 15 $mm^2/s$. Viscosity beyond the above range causes problems, e.g., insufficient viscosity at low temperature when it exceeds the above range, and increased friction at rubbing surfaces of engine parts (e.g., piston ring and valve train mechanism) when it is below the above range.

(2) Calcium Salicylate Overbased with Calcium Carbonate

The lubricant oil composition of the present invention contains calcium salicylate overbased with calcium carbonate as the essential component A. Calcium salicylate overbased with calcium carbonate has a total base number of 30 to 350 mgKOH/g in the case of the first aspect of the invention, or 30 to 100 mgKOH/g in the case of the second aspect of the invention, as determined by the perchloric acid method in accordance with JIS K2501.

Calcium salicylate overbased with calcium carbonate as the component A can be produced optionally by the known methods. The commercial product may be used as the component A for the present invention. These commercial products include SAP005 (Shell Chemical) having a total base number of 280 mgKOH/g, OSCA431 (OSCA Chemical) having a total base number of 60 mgKOH/g and so on.

The component A is incorporated at 0.10 to 0.90 wt % as calcium, based on the whole composition, preferably 0.2 to 0.9 wt %, more preferably 0.5 to 0.9 wt % in the case of the first aspect of the invention. On the other hand, the component A is incorporated at 0.05 to 0.90 wt % as calcium, based on the whole composition, preferably 0.2 to 0.9 wt %, more preferably 0.5 to 0.9 wt % in the case of the second aspect of the invention. The component A may not fully exhibit its function at below 0.10 wt % as calcium in the case of the first invention or below 0.05 wt % as calcium in the case of the second invention, and above 0.90 wt % also as calcium in both cases.

(3) Succinimide and Boron-containing Succinimide

Boron-containing succinimide and/or succinimide are used as the essential component B for the present invention. Succinimide compounds useful for the present invention include monopolyalkenyl or polyalkyl succinimides shown by the general formula [I]

[I]

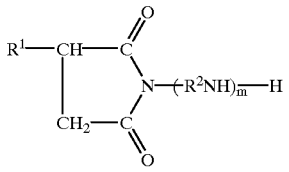

or bis-polyalkenyl or bis-polyalkyl succinimides shown by the general formula [II]:

[II]

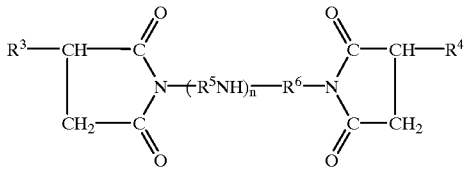

The boron-containing succinimide compound is obtained by treating a mono-succinimide shown by the general formula [I] or a bis-succinimide shown by the general formula [II] with a boron compound.

In the general formulae [I] and [II], $R^1$, $R^3$ and $R^4$ are each an oligomer residue of α-olefin the α-olefin having a carbon number of around 2 to 8, or a hydrogenated product thereof where $R^3$ and $R^4$ are the same or different from each other; $R^2$, $R^5$ and $R^6$ are each an alkylene group having a carbon number of 2 to 4, where $R^5$ and $R^6$ are the same or different from each other; and (m) is an integer of 1 to 10 and (n) is an integer of 0 to 10.

The component B for the present invention may be a mono-succinimide or boron-treated one thereof shown by the general formula [I], bis-succinimide or boron-treated one thereof shown by the general formula [II], or a combination thereof.

The polyalkenyl or polyalkyl succinimide shown by the general formula [I] or [II] is obtained by reacting a polyalkenyl succinic anhydride or polyalkyl succinic anhydride or the hydrotreated product thereof with a polyalkylene amine, the former being produced normally by reacting a polyolefin with maleic anhydride. The mono- and bis-polyalkenyl or -polyalkyl succinimide can be produced by changing reaction ratio between polyalkenyl or polyalkyl succinic anhydride and polyalkylene polyamine.

The polyolefin as the starting material for polyalkenyl or polyalkyl succinimide is selected optionally from polymers of α-olefin compounds which α-olefin compounds have a carbon number of around 2 to 8. The polyolefin may be obtained by polymerizing one type of α-olefin compound or a combination of 2 or more types of α-olefin compounds. The polyolefin is preferably polybutene.

Examples of the polyalkylene polyamine useful for the present invention include polyethylene polyamine, polypropylene polyamine and polybutylene polyamine, of which polyethylene polyamine is preferable.

The boron-treated polyalkenyl or polyalkyl succinimide can be produced by the method generally used. Boron is contained in the boron-treated product generally at 0.1 to 5 wt %, preferably 0.1 to 2 wt %.

It is necessary for the boron-containing succinimide compound as the component B for the lubricant oil composition of the present invention for internal combustion engines to have a weight-average molecular weight of 3000 or less, preferably 2000 or less. The compound having a weight-average molecular weight above 3000 may not fully exhibit its function of agglomerating solid impurities, e.g., soot, in oil and making them sufficiently coarse. These solid impurities will be agglomerated and become coarse sufficiently, when the lubricant oil composition used has a weight-average molecular weight of 3000 or less, in particular 2000 or less. It is necessary for the succinimide compound as the component B for the lubricant oil composition of the first aspect of the invention for internal combustion engines to have a weight-average molecular weight of 2500 or less, preferably 2100 or less. The compound having a weight-average molecular weight above 2500 may not fully exhibit its function of agglomerating solid impurities, e.g., soot, in oil and making them sufficiently coarse. These solid impurities will be agglomerated and become coarse sufficiently, when the lubricant oil composition has, in particular, a weight-average molecular weight of 2100 or less. On the other hand, it is necessary for the succinimide compound as the component B for the lubricant oil composition Of the second aspect of the invention for internal combustion engines to have a weight-average molecular weight of 3000 or less, preferably 2100 or less. The compound having a weight-average molecular weight above 3000 may not fully exhibit its function of agglomerating solid impurities, e.g., soot, in oil and making them sufficiently coarse. These solid impurities will be agglomerated and become coarse sufficiently similar to the case of the first present invention, when the lubricant oil composition has, in particular, a weight-average molecular weight of 2100 or less. The above weight-average molecular weight is as polybutene, determined by gel permeation chromatography (GPC).

It is necessary for the boron-containing succinimide compound as the component B for the lubricant oil composition of the present invention for internal combustion engines to contain boron at 0.04 wt % or less as that derived from the boron-containing succinimide compound, based on the whole composition, preferably 0.01 to 0.03 wt %, more preferably 0.01 to 0.02 wt %. The compound containing boron at above 0.04 wt % may not fully exhibit its function. It is necessary for the succinimide compound as the component B for the lubricant oil composition of the present invention for internal combustion engines to contain nitrogen at 0.01 to 0.25 wt %, based on the whole composition, preferably 0.03 to 0.10 wt %, more preferably 0.04 to 0.08 wt %. The target object may not be fully achieved, when the component B is contained at below 0.01 wt % and above 0.25 wt % as nitrogen.

(4) Other Additive Components

The lubricant oil composition of the present invention for internal combustion engines comprises a base oil composed of a mineral and/or synthetic oil, which is incorporated with the above components A and B as the essential components. The base oil may be optionally incorporated further with one or more types of additives which are normally used for lubricant oils for internal combustion engines, so long as the object of the present invention is not damaged. These additives include viscosity index improver, pour point depressant, metallic detergent, antioxidant, friction reducing agent, antiwear agent, extreme pressure agent, metal deactivator, rust inhibitor, antifoamant, corrosion inhibitor and coloring agent.

The viscosity index improvers useful for the present invention include polymethacrylate-based ones, olefin copolymer-based ones (e.g., isobutylene-based and ethylene-propylene copolymer-based ones), polyalkyl styrene-based ones, hydrogenated styrene-butadiene copolymer-based ones, and styrene-maleic anhydride ester copolymer-based ones. The viscosity index improver, when one is used, is incorporated normally at 1 to 30 wt %.

The pour point depressants useful for the present invention include ethylene-vinyl acetate copolymers, condensates of chlorinated paraffin and naphthalene, condensates of chlorinated paraffin and phenol, polymethacrylates, and polyalkyl styrenes. Of these, polymethacrylates are preferably used. The pour point depressant, when one is used, is incorporated normally at 0.01 to 5 wt %.

The metallic detergents useful for the present invention include those based on sulfonate of Ca, Mg, Ba, Na or the like, phenate, salicylate and phosphonate, in addition to calcium salicylate overbased with calcium carbonate as one of the essential components. The metallic detergent, when one is used, is incorporated normally at 0.05 to 5 wt %.

The antioxidants useful for the present invention include amine-based ones, e.g., alkylated diphenyl amine, phenyl-α-naphthyl amine and alkylated phenyl-α-naphthyl amine; phenol-based ones, e.g., 2,6-ditertiary butyl phenol and 4,4'-methylene bis-(2,6-6-ditertiary butyl phenol); sulfur-based ones, e.g., dilauryl-3,3'-thiodipropionate; phosphorus-based ones, e.g., phosphite; and zinc dithiophosphate. Of these, amine-based and phenol-based antioxidants are preferably used. The oxidation inhibitor, when one is used, is incorporated normally at 0.05 to 5 wt %.

The friction reducing agents useful for the present invention include organomolybdenum compounds, fatty acids, higher alcohols, fatty acid esters, oils and greases, amines, amides, sulfided esters, phosphoric acid esters, phosphorous acid esters and phosphoric acid ester amines. The friction reducing agent, when one is used, is incorporated normally at 0.05 to 3 wt %.

The antiwear agents useful for the present invention include zinc dithiophosphate, metallic (e.g., Pb, Sb and Mo) salts of dithiophosphoric acid, metallic (e.g., Zn, Pb, Sb and Mo) salts of dithiocarbamic acid, metallic (e.g., Pb) salts of naphthenic acid, metallic (e.g., Pb) salts of fatty acids, boron compounds, phosphoric acid esters, phosphorous acid esters and phosphoric acid amines. Of these, zinc dithiophosphoric acid is preferably used. The antiwear agent, when one is used, is incorporated normally at 0.1 to 5 wt %.

The extreme pressure agents useful for the present invention include ashless-based sulfide compounds, sulfided fats and greases, phosphoric acid esters, phosphorous acid esters and phosphoric acid amines. The extreme pressure agent, when one is used, is incorporated normally at 0.05 to 3 wt %.

The metal deactivators useful for the present invention include benzotriazole, triazole derivatives, benzotriazole derivatives and thiadiazole derivatives. The metal deactivator, when one is used, is incorporated normally at 0.001 to 3 wt %.

The rust inhibitors useful for the present invention include fatty acids, alkenyl succinic acid half esters, fatty acid soaps, alkyl sulfonates, esters of fatty acids and polyalcohols, aliphatic amines, oxidized paraffin compounds and alkyl polyoxyethylene ethers. The rust inhibitor, when one is used, is incorporated normally at 0.01 to 3 wt %.

The antifoamants useful for the present invention include dimethyl polysiloxane and polyacrylate. The antifoamant, when one is used, is incorporated normally at a very small content, e.g., around 0.002 wt %.

The lubricant oil composition of the present invention for internal combustion engines may be further incorporated, as required, with other types of additives, e.g., corrosion inhibitor and coloring agent.

EXAMPLES

The present invention is described in detail by Examples and Comparative Examples, which by no means limit the present invention. The methods used in Examples and Comparative Examples to determine viscosity increase rate of lubricant oil as a result of contamination with soot and average size of soot in the oil are described below.

Methods to Determine Viscosity Increase Rate of Lubricant Oil as a Result of Contamination With Soot and Average Size of Soot in the Oil A lubricant oil composition was prepared with soot incorporated in the composition at a given content, where a commercial diesel engine was operated with the base oil alone to collect the soot, which was concentrated before use. Kinematic viscosity of the lubricant oil was determined in accordance with JIS K2283 one day after the soot was incorporated, to determine viscosity increase rate of the lubricant oil as a result of contamination with soot. Average particle size of the soot in the lubricant oil was determined one day after the soot was incorporated by the light scattering method. It is judged that the soot particles in the lubricant oil are agglomerated and become coarse, when increased kinematic viscosity increase rate is observed. An average soot particle size of at least 0.2 μm (200 nm) is set as the target, because the particles of the above size can be captured and removed by an oil filter.

Example 1

A solvent-refined, paraffin-based mineral oil (viscosity: 5.8 $mm^2/s$ at 100° C.) was used as the base oil. It was incorporated with calcium salicylate overbased with calcium carbonate to have a total base number (TBN) of 250 mgKOH/g at 0.60 wt % as calcium, boron-containing succinimide having a weight-average molecular weight of 1804 at 0.012 wt % as boron (or 0.06 wt % as nitrogen), and an antiwear agent, viscosity index improver, pour point depressant and antifoamant as the other additives at a total content of 5.82 wt %, to prepare the lubricant oil composition, where the above percentages are based on the whole composition. Viscosity increase rate of lubricant oil as a result of contamination with soot and average size of soot in the oil were measured for the above lubricant oil composition, after it was incorporated with 4.0 wt % of soot. The results are given in Table 1. It is observed that viscosity increase rate increases, and average size of the soot particles in the oil also increases to 378 nm.

Example 2

A solvent-refined, paraffin-based mineral oil (viscosity: 5.8 $mm^2/s$ at 100° C.) was used as the base oil, as was the case with Example 1. It was incorporated with calcium salicylate overbased with calcium carbonate to have a total base number (TBN) of 250 mgKOH/g at 0.60 wt % as calcium, boron-containing succinimide having a weight-average molecular weight of 1392 at 0.013 wt % as boron (or 0.06 wt % as nitrogen), and a antiwear agent, viscosity index improver, pour point depressant and antifoamant as the other additives at a total content of 5.82 wt %, also as was the case with Example 1, to prepare the lubricant oil composition, where the above percentages are based on the whole composition. Viscosity increase rate of lubricant oil as a result of contamination with soot and average size of soot in the oil were measured with the above lubricant oil composition, after it was incorporated with 4.0 wt % of soot. The results are given in Table 1. It is observed that viscosity increase rate increases, and average size of the soot particles in the oil also as was the case with Example 1, increases to 370 nm.

Example 3

A solvent-refined, paraffin-based mineral oil (viscosity: 5.8 $mm^2/s$ at 100° C.) was used as the base oil, as was the case with Examples 1 and 2. It was incorporated with calcium salicylate overbased with calcium carbonate to have a total base number (TBN) of 250 mgKOH/g at 0.60 wt % as calcium, succinimide having a weight-average molecular weight of 2065 at 0.06 wt % as nitrogen, and a antiwear agent, viscosity index improver, pour point depressant and antifoamant as the other additives at a total content of 5.82 wt %, also as was the case with Examples 1 and 2, to prepare the lubricant oil composition, where the above percentages are based on the whole composition. Viscosity increase rate of lubricant oil as a result of contamination with soot and average size of soot in the oil were measured for the above lubricant oil composition, after it was incorporated with 4.0 wt % of soot. The results are given in Table 1. It is observed that viscosity increase rate increases, and average size of the soot particles in the oil also as was the case with Examples 1 and 2, increases to 365 nm.

Examples 4 to 6

A solvent-refined, paraffin-based mineral oil (viscosity: 5.8 $mm^2/s$ at 100° C.) was used as the base oil, as was the case with Examples 1 to 3. It was incorporated with calcium salicylate overbased with calcium carbonate to have a total base number (TBN) of 70 mgKOH/g at 0.18 wt % as calcium in Example 4, at 0.10 wt % as calcium in Example 5 or at 0.06 wt %, as calcium in Example 6, succinimide having a weight-average molecular weight of 2567 at 0.06 wt % as nitrogen, and a antiwear agent, viscosity index improver, pour point depressant and antifoamant as the other additives at a total content of 5.82 wt %, also as was the case with Examples 1 to 3, to prepare the lubricant oil composition, where the above percentages are based on the whole composition. Viscosity increase rate of lubricant oil as a result of contamination with soot and average size of soot in the oil were measured for the above lubricant oil composition, after it was incorporated with 4.0 wt % of soot. The results are given in Table 1. It is observed that viscosity increase rate increases, and average size of the soot particles in the oil increases also as was the case with Example 1 to 3.

TABLE 1

| | | | Example 1 | Example 2 | Example 3 | Example 4 | Example 5 | Example 6 |
|---|---|---|---|---|---|---|---|---|
| Mineral oil | | wt % | Balance | Balance | Balance | Balance | Balance | Balance |
| Overbased calcium salicylate (TBN 250 mgKOH/g) | as Ca | wt % | 0.60 | 0.60 | 0.60 | — | — | — |
| Overbased calcium salicylate (TBN 70 mgKOH/g) | as Ca | wt % | | | | 0.18 | 0.10 | 0.06 |
| Overbased calcium phenate (TBN 250 mg/KOH/g) | as Ca | wt % | — | — | — | — | — | — |
| Overbased calcium sulfonate (TBN 250 mg/KOH/g) | as Ca | wt % | — | — | — | — | — | — |
| Boron-containing succinimide (MW1804) | as N/B | wt % | 0.06/0.012 | — | — | — | — | — |
| Boron-containing succinimide (MW1392) | as N/B | wt % | — | 0.06/0.013 | — | — | — | — |
| Succinimide (MW2065) | as N | wt % | — | — | 0.06 | — | — | — |
| Succinimide (MW2567) | as N | wt % | — | — | — | 0.06 | 0.06 | 0.06 |
| Other additives* | | wt % | 5.82 | 5.82 | 5.82 | 5.82 | 5.82 | 5.82 |
| Soot content in the lubricant | | wt % | 4.0 | 4.0 | 4.0 | 4.0 | 4.0 | 4.0 |
| Soot-induced viscosity increase | % | @ 40° C. | 212 | 219 | 235 | 281 | 193 | 125 |
| | | @ 100° C. | 435 | 342 | 522 | 761 | 533 | 330 |
| Average size of the soot particles in the lubricant oil (number-average) | | nm | 378 | 370 | 365 | 292 | 215 | 203 |

*The same types of antiwear agent, viscosity index improver, pour point depressant and antifoamant were incorporated in the base oil at the same contents.
*TBN: total base number, determined by the perchloric acid method.
*MW: weight-average molecular weight, as polybutene, determined by the GPC method.

Comparative Examples 1 to 9

The lubricant oil compositions for internal combustion engines were prepared in a manner similar to those for Examples 1 to 6, where the mineral oil as the base oil was incorporated with various additive components shown in Table 2. Viscosity increase rate of lubricant oil as a result of contamination with soot and average size of soot in the oil were measured with each lubricant oil composition, after it was incorporated with 4.0 wt % of soot. The results are given in Table 2. As shown, each composition increased viscosity increase rate to a smaller extent, and average size of the soot particles in the oil also to a smaller extent to 200 nm or less than the composition prepared in Examples 1 to 6.

TABLE 2

| | | | Comparative Example 1 | Comparative Example 2 | Comparative Example 3 | Comparative Example 4 | Comparative Example 5 |
|---|---|---|---|---|---|---|---|
| Mineral oil | | wt % | Balance | Balance | Balance | Balance | Balance |
| Overbased calcium salicylate (TBN 250 mgKOH/g) | as Ca | wt % | 0.60 | — | — | — | — |
| Overbased calcium phenate (TBN 250 mgKOH/g) | as Ca | wt % | — | 0.61 | 0.61 | 0.61 | 0.61 |
| Overbased calcium sulfonate (TBN 250 mg/KOH/g) | as Ca | wt % | — | — | — | — | — |
| Boron-containing succinimide (MW1804) | as N/B | wt % | — | 0.06/0.012 | — | — | — |
| Boron-containing succinimide (MW1392) | as N/B | wt % | — | — | 0.06/0.013 | — | — |
| Succinimide (MW2065) | as N | wt % | — | — | — | 0.06 | — |
| Succinimide (MW2567) | as N | wt % | 0.06 | — | — | — | 0.06 |
| Other additives* | | wt % | 5.82 | 5.82 | 5.82 | 5.82 | 5.82 |
| Soot content in the lubricant | | wt % | 4.0 | 4.0 | 4.0 | 4.0 | 4.0 |
| Soot-induced viscosity increase | % | @ 40° C. | 97.6 | 88 | 45 | 69 | 35 |
| | | @ 100° C. | 166 | 172 | 73 | 124 | 43 |
| Average size of the soot particles in the lubricant oil (number-average) | | nm | 161 | 180 | 172 | 170 | 153 |

| | | | Comparative Example 6 | Comparative Example 7 | Comparative Example 8 | Comparative Example 9 |
|---|---|---|---|---|---|---|
| Mineral oil | | wt % | Balance | Balance | Balance | Balance |
| Overbased calcium salicylate (TBN 250 mgKOH/g) | as Ca | wt % | — | — | — | — |
| Overbased calcium phenate (TBN 250 mgKOH/g) | as Ca | wt % | — | — | — | — |
| Overbased calcium sulfonate (TBN 250 mg/KOH/g) | as Ca | wt % | 0.67 | 0.67 | 0.67 | 0.67 |
| Boron-containing succinimide (MW1804) | as N/B | wt % | 0.06/0.012 | — | — | — |
| Boron-containing succinimide (MW1392) | as N/B | wt % | — | 0.06/0.013 | — | — |
| Succinimide (MW2065) | as N | wt % | — | — | 0.06 | — |
| Succinimide (MW2567) | as N | wt % | — | — | — | 0.06 |
| Other additives* | | wt % | 5.82 | 5.82 | 5.82 | 5.82 |
| Soot content in the lubricant | | wt % | 4.0 | 4.0 | 4.0 | 4.0 |
| Soot-induced viscosity increase | % | @ 40° C. | 72 | 48 | 106 | 37 |
| | | @ 100° C. | 103 | 57 | 189 | 41 |
| Average size of the soot particles in the lubricant oil (number-average) | | nm | 185 | 178 | 193 | 169 |

*The same types of antiwear agent, viscosity index improver, pour point depressant and antifoamant were incorporated in the base oil at the same contents.

*TBN: total base number, determined by the perchloric acid method.

*MW: weight-average molecular weight, as polybutene, determined by the GPC method.

Comparative Examples 10 to 18

The lubricant oil compositions for internal combustion engines were prepared in a manner similar to those for Examples 1 to 6 and Comparative Examples 1 to 9, where the mineral oil as the base oil was incorporated with various additive components shown in Table 3. Viscosity increase rate of lubricant oil as a result of contamination with soot and average size of soot in the oil were measured with each lubricant oil composition, after it was incorporated with 4.0 wt % of soot. The results are given in Table 3. As shown, each composition increased viscosity increase rate to a smaller extent, and average size of the soot particles in the oil to a smaller extent to 200 nm or less than the composition prepared in Examples 1 to 6, as was the case with Comparative Examples 1 to 9.

TABLE 3

| | | | Comparative Example 10 | Comparative Example 11 | Comparative Example 12 | Comparative Example 13 | Comparative Example 14 |
|---|---|---|---|---|---|---|---|
| Mineral oil | | wt % | Balance | Balance | Balance | Balance | Balance |
| Overbased calcium salicylate (TBN 250 mgKOH/g) | as Ca | wt % | 0.03 | — | — | — | — |
| Overbased calcium phenate (TBN 250 mgKOH/g) | as Ca | wt % | — | 0.27 | 0.16 | 0.10 | 0.05 |
| Overbased calcium sulfonate (TBN 250 mg/KOH/g) | as Ca | wt % | — | — | — | — | — |
| Boron-containing succinimide (MW1804) | as N/B | wt % | — | — | — | — | — |
| Boron-containing succinimide (MW1392) | as N/B | wt % | — | — | — | — | — |
| Succinimide (MW2065) | as N | wt % | — | — | — | — | — |
| Succinimide (MW2567) | as N | wt % | 0.06 | 0.06 | 0.06 | 0.06 | 0.06 |
| Other additives* | | wt % | 5.82 | 5.82 | 5.82 | 5.82 | 5.82 |
| Soot content in the lubricant | | wt % | 4.0 | 4.0 | 4.0 | 4.0 | 4.0 |
| Soot-induced viscosity increase | % | @ 40° C. | 123 | 42.3 | 61.3 | 26.7 | 29.5 |
| | | @ 100° C. | 90 | 64.6 | 61.2 | 37.2 | 38.7 |
| Average size of the soot particles in the lubricant oil (number-average) | | nm | 171 | 150 | 163 | 137 | 123 |

| | | | Comparative Example 15 | Comparative Example 16 | Comparative Example 17 | Comparative Example 18 |
|---|---|---|---|---|---|---|
| Mineral oil | | wt % | Balance | Balance | Balance | Balance |
| Overbased calcium salicylate (TBN 250 mgKOH/g) | as Ca | wt % | — | — | — | — |
| Overbased calcium phenate (TBN 250 mgKOH/g) | as Ca | wt % | — | — | — | — |
| Overbased calcium sulfonate (TBN 250 mg/KOH/g) | as Ca | wt % | 0.34 | 0.21 | 0.12 | 0.67 |
| Boron-containing succinimide (MW1804) | as N/B | wt % | — | — | — | — |
| Boron-containing succinimide (MW1392) | as N/B | wt % | — | — | — | — |
| Succinimide (MW2065) | as N | wt % | — | — | — | — |
| Succinimide (MW2567) | as N | wt % | 0.06 | 0.06 | 0.06 | 0.06 |
| Other additives* | | wt % | 5.82 | 5.82 | 5.82 | 5.82 |
| Soot content in the lubricant | | wt % | 4.0 | 4.0 | 4.0 | 4.0 |
| Soot-induced viscosity increase | % | @ 40° C. | 65.6 | 68.7 | 46.6 | 33.8 |
| | | @ 100° C. | 95.9 | 79.5 | 53.3 | 39.3 |

TABLE 3-continued

| | | | | | |
|---|---|---|---|---|---|
| Average size of the soot particles in the lubricant oil (number-average) | nm | 182 | 185 | 166 | 149 |

*The same types of antiwear agent, viscosity index improver, pour point depressant and antifoamant were incorporated in the base oil at the same contents.
*TBN: total base number, determined by the perchloric acid method.
*MW: weight-average molecular weight, as polybutene, determined by the GPC method.

It is apparent, as shown by the results of Examples, that that the lubricant oil composition exhibits an excellent effect of agglomerating solid impurities (soot) insoluble in oil to a sufficient size to allow an oil filter to easily capture and remove them, when its base oil is incorporated with specified contents of (A) calcium salicylate overbased with calcium carbonate and (B) boron-containing succinimide or succinimide having a specified weight-average molecular weight or less, as the essential components for the present invention. Taking the lubricant oil composition prepared by Example 1 as an example, it agglomerates the soot to an average particle size of 378 nm, which well exceeds the average size of 200 nm considered to be the threshold size of the particles captured and removed by an oil filter, and hence should allow the soot to be captured and removed by an oil filter and exhibit a long service life. The lubricant oil compositions prepared by Examples 2 to 6 exhibit similar effects.

On the other hand, the lubricant oil composition for internal combustion engines prepared by Comparative Example 1 incorporates succinimide having a weight-average molecular weight above the specified level in place of one of the essential components for the present invention, i.e., the component B of boron-containing succinimide or succinimide having a specified weight-average molecular weight or less. It fails to increase size of the soot particles to the target level, 200 nm on the average. The lubricant oil compositions prepared by Comparative Examples 2 to 5 or 11 to 14 incorporate overbased calcium phenate in place of one of the essential components for the present invention, i.e., the component A of calcium salicylate overbased with calcium carbonate. Each of them fails to increase size of the soot particles to the target level, 200 nm on the average. The lubricant oil compositions prepared by Comparative Examples 6 to 9 or 15 to 18 incorporate overbased calcium sulfonate in place of one of the essential components for the present invention, i.e., the component A of calcium salicylate overbased with calcium carbonate. Each of them fails to sufficiently increase size of the soot particles, as are the cases with Comparative Examples 2 to 5 or 11 to 14.

These results indicate that a lubricant oil composition cannot sufficiently agglomerate the oil-insoluble solid impurities (soot), unless its base oil is incorporated with (A) calcium salicylate overbased with calcium carbonate and having a total base number within specified limits and (B) boron-containing succinimide having a specified weight-average molecular weight or less and/or succinimide having a specified weight-average molecular weight or less. It is apparent that such a lubricant oil composition lacking the recited materials will not be a high-quality one for internal combustion engines, because solid impurities it contains cannot be sufficiently captured and removed by an oil filter. It is therefore apparent that a lubricant oil composition can be serviceable for extended periods on account of its excellent effect of agglomerating the oil-insoluble solid impurities (soot) it contains to a sufficiently large size as to be captured and removed by an oil filter, when its base oil is incorporated with (A) calcium salicylate overbased with calcium carbonate and having a total base number within specified limits and (B) boron-containing succinimide having a specified weight-average molecular weight or less and/or succinimide having a specified weight-average molecular weight or less.

The lubricant oil composition of the present invention can be serviceable for extended periods on account of its excellent effect of agglomerating the oil-insoluble solid impurities (soot) it contains to a sufficiently large size as to be captured and removed by an oil filter, by incorporating in the base oil (A) calcium salicylate overbased with calcium carbonate and having a total base number within specified limits and (B) boron-containing succinimide having a specified weight-average molecular weight or less and/or succinimide having a specified weight-average molecular weight or less.

The present invention is a lubricant oil composition comprising a base oil composed of a mineral and/or synthetic oil which is treated with (A) calcium salicylate overbased with calcium carbonate and having a total base number within specified limits with specified contents (as calcium) and (B) boron-containing succinimide having a specified weight-average molecular weight or less at 0.04 wt % or less (as boron derived from the boron-containing succinimide) and/or succinimide having a specified weight-average molecular weight or less at 0.01 to 0.25 wt % (as nitrogen), the above percentages being based on the whole composition.

What is claimed is:

1. A lubricant oil composition for internal combustion engines, comprising a base oil composed of a mineral oil, synthetic oil or mixture thereof which is treated with (A) calcium salicylate overbased with calcium carbonate and having a total base number of 30 to 350 mgKOH/g at 0.10 to 0.90 wt % ,as calcium, and (B) a succinimide selected from the group consisting of a boron-containing succinimide having a weight-average molecular weight of 3,000 or less at less than 0.03 wt %, as boron derived from the boron-containing succinimide, and a succinimide having a weight-average molecular weight of 2,500 or less at 0.01 to 0.25 wt %, as nitrogen and mixtures thereof, the above percentage being based on the whole composition.

2. A lubricant oil composition for internal combustion engines, comprising a base oil composed of a mineral oil, synthetic oil or mixture thereof which is treated with (A) calcium salicylate overbased with calcium carbonate and having a total base number of 30 to 100 mgKOH/g at 0.05 to 0.90 wt %, as calcium, and (B) a succinimide selected from the group consisting of boron-containing succinimide having a weight-average molecular weight of 3,000 or less at less than 0.03 wt %, as boron derived from the boron-containing succinimide, and a succinimide having a weight-average molecular weight of 2,500 or less at 0.01 to 0.25 wt %, as nitrogen, the above percentages being based on the whole composition.

3. The lubricant oil of claim 1 wherein the calcium salicylate overbased with calcium carbonate and having a total base number of 30 to 350 mgKOH/g is used at a treat of 0.2 to 0.9wt % (as calcium).

4. The lubricant oil of claim 2 wherein the calcium salicylate overbased with calcium carbonate and having a total base number of 30 to 100 mgKOH/g is used at a treat of 0.2 to 0.9 wt % (as calcium).

5. The lubricant oil of claim 1 or 2 wherein the calcium salicylate overbased with calcium carbonate is used at a treat of 0.5 to 0.9 wt % (as calcium).

6. The lubricant oil of claim 1 or 2 wherein the boron containing succinimide is used at a treat of 0.01 to 0.03 wt % (as boron derived from the boron-containing succinimide), while the succinimide having a weight average molecular weight of 2500 or less is used at a treat of 0.03 to 0.10 wt % (as nitrogen).

7. The lubricant oil of claim 1 or 2 wherein the boron containing succinimide is used at a treat of 0.01 to 0.02 wt % (or boron derived from the boron-containing succinimide), while the succinimide having a weight average molecular weight of 2500 or less is used at a treat of 0.04 to 0.08 wt % (as nitrogen).

* * * * *